US006695923B1

(12) United States Patent
Schultz et al.

(10) Patent No.: US 6,695,923 B1
(45) Date of Patent: Feb. 24, 2004

(54) MULTIPLE ORIFICE APPLICATOR SYSTEM AND METHOD OF USING SAME

(75) Inventors: Carl L. Schultz, Plymouth, MI (US); Denise Dudra, Fowlerville, MI (US); Thomas R. Tudor, Westland, MI (US)

(73) Assignee: Sealant Equipment & Engineering, Inc., Plymouth, MI (US)

( * ) Notice: Subject to any disclaimer, the term of this patent is extended or adjusted under 35 U.S.C. 154(b) by 0 days.

(21) Appl. No.: 09/990,607

(22) Filed: Nov. 21, 2001

Related U.S. Application Data

(60) Provisional application No. 60/253,070, filed on Nov. 21, 2000.

(51) Int. Cl.[7] ..... B05C 11/00

(52) U.S. Cl. ..... 118/679; 118/323; 118/684; 118/411

(58) Field of Search ..... 118/411, 686, 118/687, 315, 323, 667, 324, 302, 679–684, 669, 666; 901/43; 239/556, 557, 566, 583, 569, 135

(56) References Cited

U.S. PATENT DOCUMENTS 3,602,193 A * 8/1971 Adams et al.
4,367,532 A * 1/1983 Crum et al.
4,378,959 A * 4/1983 Susnjara
4,620,831 A * 11/1986 Poncet et al.
4,622,239 A * 11/1986 Schoenthaler et al.
4,687,137 A * 8/1987 Boger et al.
4,766,844 A * 8/1988 Brewer et al.
4,864,966 A * 9/1989 Anderson et al.
4,872,417 A * 10/1989 Kuwabara et al.
4,938,383 A * 7/1990 Yamazaki et al.
4,938,994 A * 7/1990 Choinski
4,961,955 A * 10/1990 Goldberg
5,046,666 A * 9/1991 Ono
5,061,170 A * 10/1991 Allen et al.
5,187,123 A * 2/1993 Yoshida et al.
5,335,825 A 8/1994 Fort
5,421,941 A * 6/1995 Allen et al.
6,001,425 A * 12/1999 Stash et al.
6,270,579 B1 * 8/2001 Subramanian et al.
6,471,774 B1 * 10/2002 Krueger

OTHER PUBLICATIONS

Nozzletech, Inc. Brochure—No date of publication given.

* cited by examiner

*Primary Examiner*—Brenda A. Lamb
(74) *Attorney, Agent, or Firm*—Rader, Fishman & Grauer PLLC

(57) ABSTRACT

A multiple orifice applicator system for dispensing a plurality of rows of fluid material onto a work piece is disclosed. A source of fluid material is in fluid communication with the multiple orifice applicator. The multiple orifice applicator is mounted to a robotic arm, which positions the multiple orifice applicator relative to the work piece to enable the multiple orifice applicator to dispense fluid material onto the work piece. Fluid material is caused to flow from the source of fluid material into the multiple orifice applicator. The fluid material enters the multiple orifice applicator through an inlet port and is dispersed and spread out in a dispersing chamber. The fluid material is dispensed onto the work piece through a plurality of outlet orifices in the multiple orifice applicator.

18 Claims, 7 Drawing Sheets

MULTIPLE ORIFICE APPLICATOR SYSTEM AND METHOD OF USING SAME

This application claims benefit of U.S. Provisional Application No. 60/253,070, filed on Nov. 21, 2000, the contents of which are incorporated herein in its entirety.

FIELD OF THE INVENTION

The present invention relates to devices for and methods of dispensing various materials, such as adhesives, epoxies, sealants, and sound dampening materials. More specifically, the present invention relates to a device for and a method of applying a relatively wide band of material to a work piece by applying multiple closely-spaced rows of the material from a multiple-orifice applicator.

BACKGROUND OF THE INVENTION

It is common in many industries to apply various fluid materials, such as adhesives, epoxies, sealants, sound deadening materials, structurally-stiffening materials, insulating materials, and the like, using robotically-controlled metering and dispensing systems. These fluid materials are commonly applied to a wide variety of items, such as automotive parts, household appliance parts, conformal coating of electronic circuit boards, medical devices, and construction items (windows, doors, etc.) during manufacture.

One known method of applying fluid materials to a work piece involves extruding the fluid material. Extrusion of fluid material generally involves maintaining an outlet nozzle of an extruding device very close to the work piece and allowing a single bead of fluid material to be applied to the work piece, either as the work piece is moved relative to the nozzle or the nozzle is moved relative to the work piece.

Another known method of applying a fluid material to a work piece is to "stream" the fluid material. "Streaming" is a relatively high-speed application process wherein the fluid material is dispensed from a nozzle under relatively high pressure and from a relatively greater distance from the work piece as compared to methods where the fluid material is extruded onto the work piece. Generally, a work piece is set in position—either robotically, via a conveyor system, or manually—and a fluid dispensing nozzle mounted to the end of a robot arm is caused to make one or more "passes" over the work piece, dispensing fluid material during each pass. Known systems for streaming fluid materials, such as that disclosed in U.S. Pat. No. 5,979,794 to DeFillipi et al., include a nozzle having a single outlet orifice for dispensing a single stream of fluid material. As a result, each pass of the dispensing mechanism over the work piece produces a single bead of fluid material that is approximately the width of the outlet orifice opening of the nozzle.

Many situations require the application of relatively wide bands, i.e., several inches wide, of fluid material to a work piece. By way of example only, various automotive sound dampening applications require the application of wide bands of sound dampening material or panel-stiffening material to a vehicle door, body panel or frame assembly. Because the outlet orifice of a streaming nozzle must maintain a relatively small diameter (to maintain the required fluid pressure to stream the material), it is not possible to stream wide bands of fluid materials onto a work piece during a single pass of the robot arm using known methods and systems for fluid streaming. Accordingly, for situations requiring wide bands of fluid materials, various application methods have been used.

One known method is to cause the application nozzle to make several passes over the work piece, thereby applying several beads or streams of fluid material adjacent each other. This method suffers from several disadvantages. First, because this method typically requires many passes by the application nozzle, the manufacturing process is slowed to accommodate the amount of time required to physically move the nozzle back and forth over the work piece until the entire band is applied. Second, it has been found to be difficult to create a continuous band of material using this method because it is difficult to ensure that adjacently-applied beads are the same thickness and that they are applied precisely adjacent to each other. Further, because fluid materials being applied to the work piece tend to "set up" relatively quickly, a previously-applied bead may not blend together with a subsequently-applied bead particularly well, thus resulting in distinct beads of material instead of a continuous band of material on the work piece.

Another known method of applying fluid material to create a relatively wide band on a work piece is known as "swirling." Swirling application systems include a single orifice nozzle that can be programmed to rotate in a circular motion. The rotating nozzle creates a circular pattern of fluid material on the work piece. As the nozzle is moved longitudinally across the work piece, the adjacent circles of material blend together to create a material band having a width equal to the diameter of the circles. Swirling systems suffer from some of the same disadvantages as described above. Further, the swirling method is sometimes imprecise, whereby "overspray" is caused as a result of the circular motion of the nozzle. Also, the width of the band of fluid material that can be created using the swirling method is relatively limited, which may result in the need for multiple passes over the work piece to achieve a desired band width. Finally, the rotating nozzle of a swirling device is actuated by a motor and other moving mechanical parts, which require significant maintenance. As a result of several of these drawbacks, the swirling method is a relatively expensive process.

Yet another known method for applying fluid material to create a wide band of material on a work piece is known as the "slot nozzle" method. The slot nozzle method involves applying fluid material using a nozzle having a single elongated orifice in the shape of a slot. While the slot nozzle method may be useful for applying wide bands of material, it has been found difficult to maintain a consistent thickness across the band of material when using a slot nozzle. The fluid material tends to accumulate closer to the middle of the band, thereby creating a band that is thicker in the middle and thinner near the edges. Further, because slot nozzles have a large continuous outlet opening, it is difficult to create sufficient fluid pressure in the system to dispense the material onto the work piece. Finally, the large outlet opening tends to allow a certain amount of fluid dripping for a period of time after the flow of fluid material is stopped.

Perhaps as a result of the limitations associated with applying fluid materials to a work piece, the standard method of applying certain materials does not involve applying a fluid material at all. For example, it is common to apply sound deadening materials and body-stiffening materials to automotive vehicle assembly such as door panels in the form of pre-die-cut melt pads. These pads are designed to be manually applied "stuck" to a vehicle body part or door panel, and then, during a subsequent "bake" stage of the manufacturing process, the high heat causes the melt pads to melt and permanently bond to the desired work surface. The use of pre-cut melt pads is undesirable because it is very labor intensive and also necessary to maintain an inventory of special melt pads in a variety of shapes and sizes. Maintaining an inventory of several different parts is difficult and this entire method is expensive. Further, any melt pads that are unused (because of body style changes, for example) become waste.

The inventors hereof have recognized that it would be desirable to have a device and method to facilitate the application of applying various fluid materials onto a work piece in a relatively wide band and generating a variety of shapes and patterns. Further, the inventors have recognized that it would be desirable to have a device and method that would avoid the use of pre-cut melt pads.

SUMMARY OF THE INVENTION

The present invention relates to a multiple orifice applicator system for applying multiple beads, streams, or ribbons of fluid material onto a work piece in a single pass of the applicator. One particularly useful application of the invention is to create a relatively wide band of material on the work piece in a single pass. The system can also be used to apply several distinct rows of fluid material on a work piece in a single pass. The inventive system includes a source of fluid material in fluid communication with a multiple orifice applicator device and a means for causing relative movement between the multiple orifice applicator and the work piece. The multiple orifice applicator has an inlet port for receiving fluid material, which opens into a fluid dispersing chamber, such as a manifold, wherein the incoming fluid material is allowed to disperse and spread out. The fluid material is forced from the dispersing chamber through a plurality of outlet orifices, which are positioned adjacent to each other. As a result, fluid material is simultaneously dispensed through multiple adjacent outlet orifices onto the work piece during a single pass. The multiple adjacent beads, ribbons, or streams of material can be dispensed so that they blend or merge with each other on the work piece to create a continuous, uniform band or pattern of fluid material, if desirable. Alternatively, the invention can be used to apply multiple distinct non-merged lines of fluid material on a work piece in a single pass.

DETAILED DESCRIPTION OF A PREFERRED EMBODIMENT

Figure 1A:
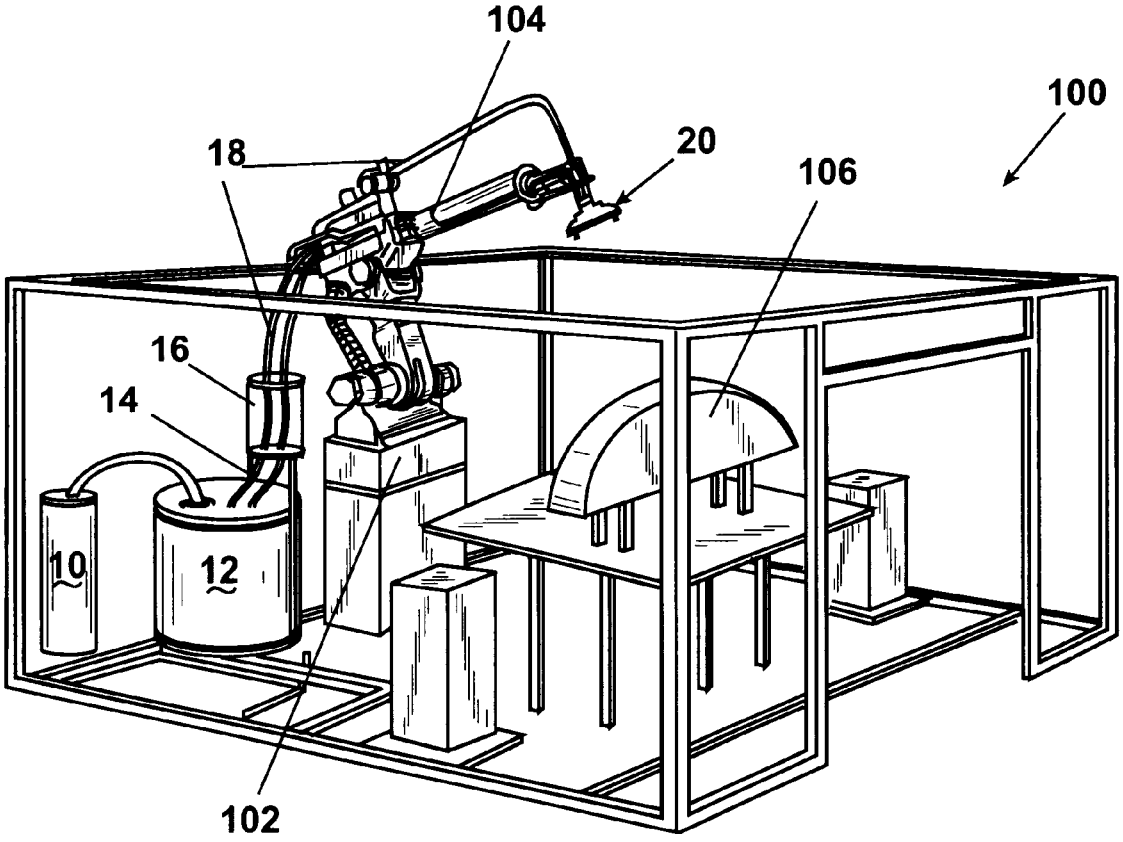
FIG. 1A is a perspective view of an illustrative metering and dispensing system, including the use of a multiple orifice applicator mounted to an articulated robot arm.

Shown in FIG. 1A is an illustrative metering and dispensing system wherein a multiple orifice applicator device of the present invention can be used. A work piece 106 is shown at a particular station of an assembly line function 100. A fluid material is stored in fluid containment vessel 12. A source of air pressure 10 provides pressure to cause the fluid material to flow from containment vessel 12 through a first conduit 14 to a heat exchanger 16, which is used to temperature condition the fluid to maintain its viscosity. The air pressure causes the fluid to flow from the heat exchanger 16 through a second conduit 18 and into multiple orifice applicator head 20. Applicator head 20 is mounted to the end of an articulating arm 104 of an electronically-controlled robot 102. The description set forth above of an illustrative metering and dispensing system for the multiple orifice applicator device 20 is not limiting, and the applicator 20 can be used in connection with a wide variety of metering and dispensing systems that dispense fluid materials. Similarly, the applicator 20 could be used in connection with known systems for metering and mixing multiple part fluids, such as two-part epoxies.

Figure 1B:
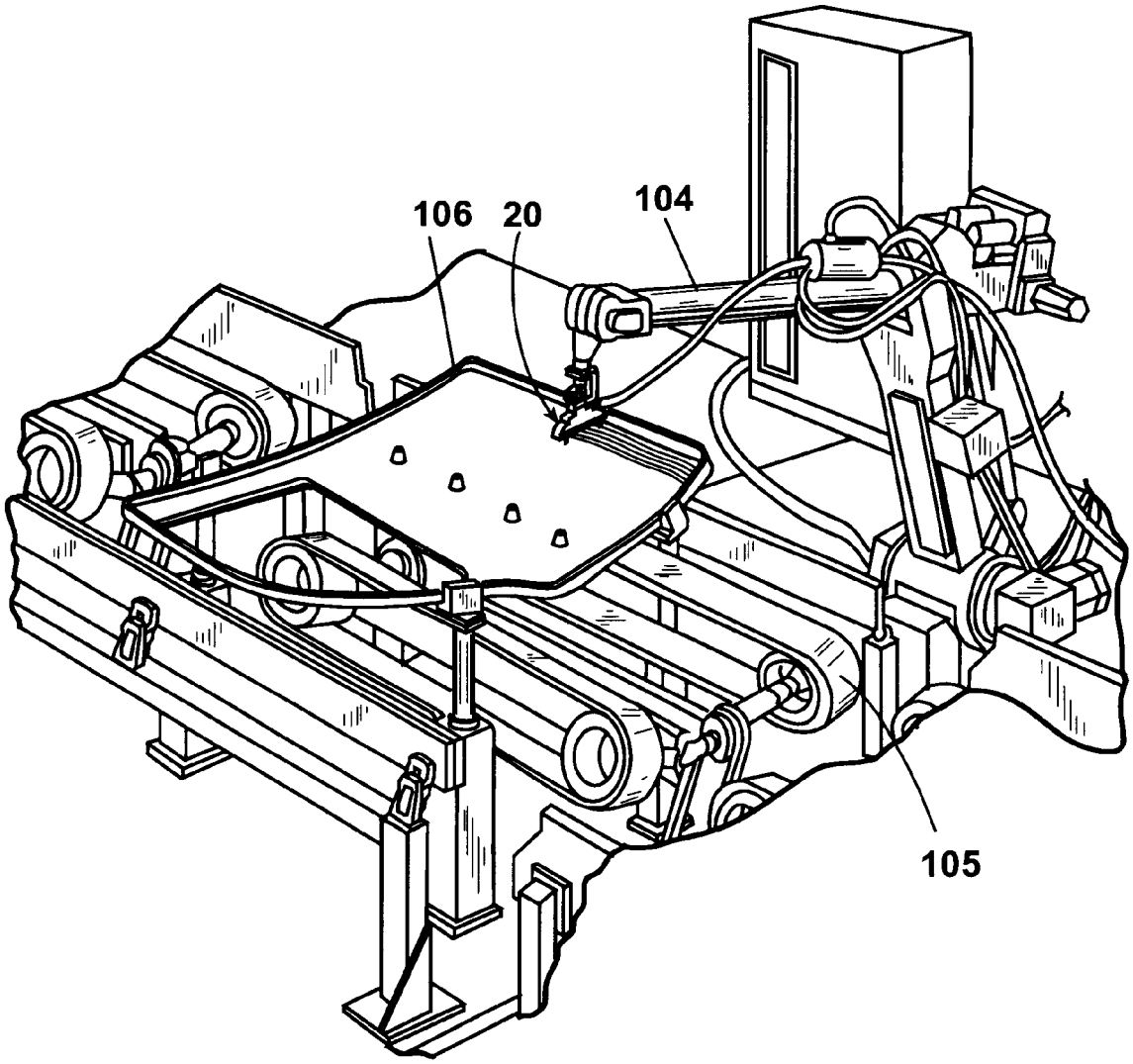
FIG. 1B is a perspective view of an illustrative metering and dispensing system, including the use of a multiple orifice applicator, an articulating robot arm and conveyor assembly line.

Furthermore, while the applicator 20 has been described above as used in connection with an articulating robotic arm, the applicator 20 can also be used in connection with a wide variety of other types of manufacturing environments. For example, FIG. 1B illustrates a multiple orifice applicator 20 being used in connection with an articulating robot 104 and a conveyor belt 105, wherein work pieces 106 are transported under the applicator 20 by the conveyor belt 105. The multiple orifice applicator 20 can also be used with other types of robots, such as SCARA robots, Cartesian robots, XYZ shape generating motion programmable fixtures, or the applicator can be fixed mounted on a fixture and the work piece moved underneath the applicator. In sum, neither the particular meter/mix system used nor the manner in which the work piece is positioned relative to the applicator 20 limits the general use and applicability of the multiple orifice applicator 20.

Figure 2:
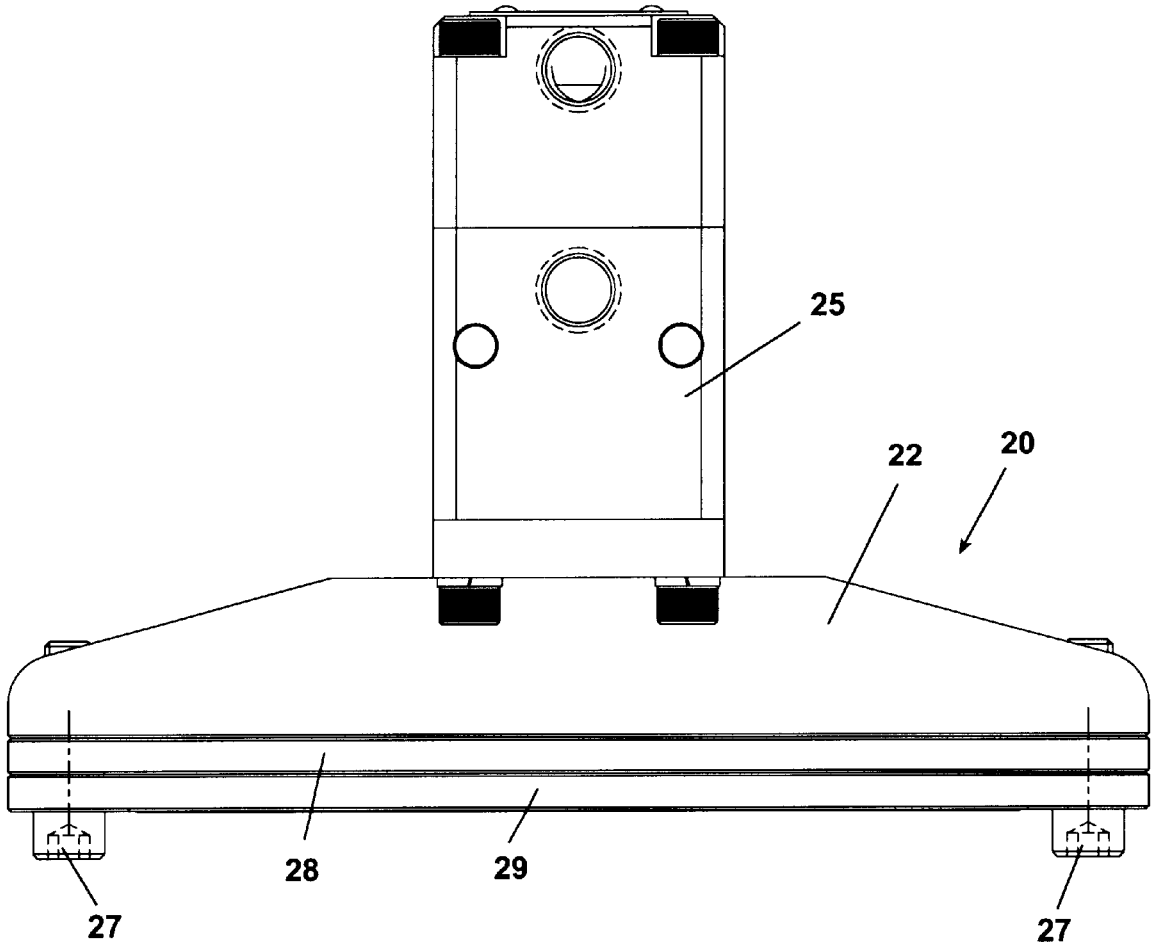
FIG. 2 is a side view of an embodiment of a multiple orifice applicator.

Referring to FIG. 2, the multiple orifice applicator 20 is shown in more detail. Applicator 20 includes an applicator body 22, an integrated valve 25, an applicator plate 28, a retaining plate 29, and bolts 27 that pass through applicator plate 28 and retaining plate 29.

Figure 3:
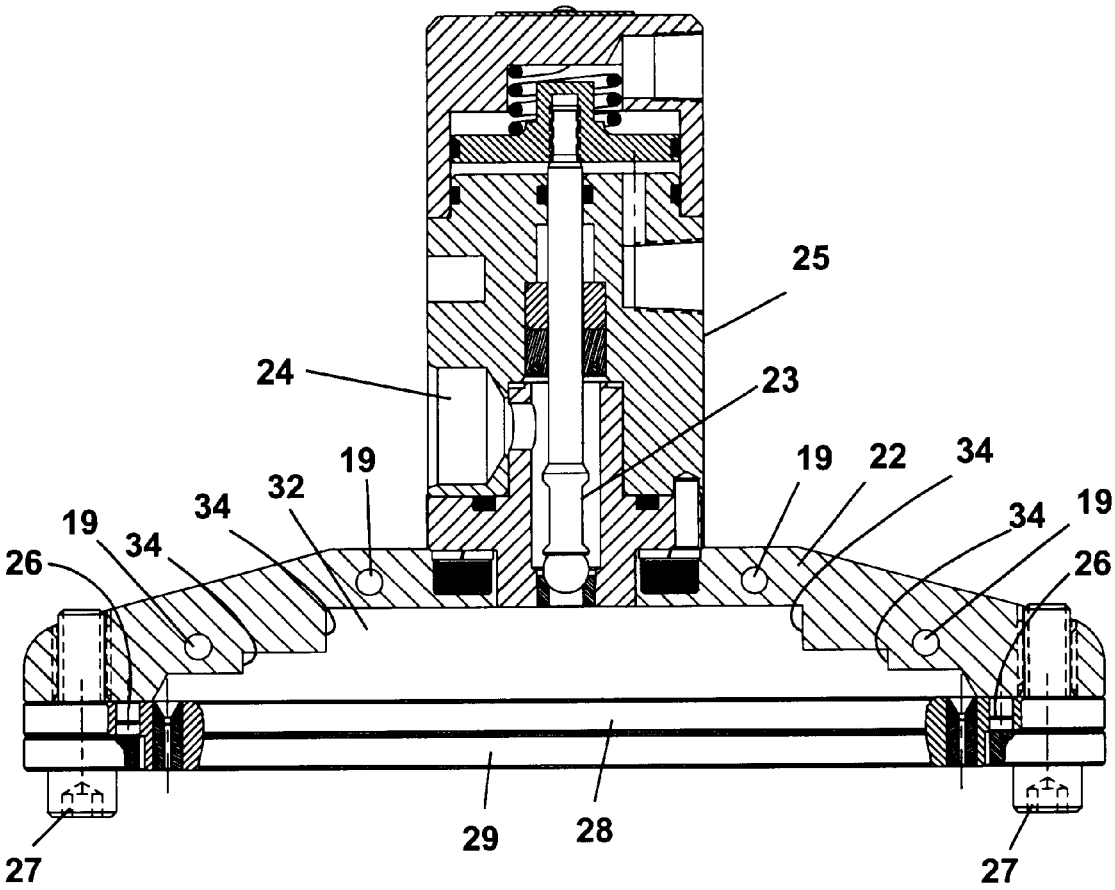
FIG. 3 is a cross-sectional side view of an embodiment of a multiple orifice applicator.

FIG. 3 illustrates a cross-sectional view of the multiple orifice applicator 20, wherein like elements of FIGS. 2 and 3 are identified by like numerals. As shown in FIG. 3, integrated valve 25 includes inlet port 24 through which fluid material from the metering system enters the applicator 20. Applicator body 22 includes a dispersing chamber 32, which is in fluid communication with inlet port 24. Valve actuator 23, which can be selectively opened and closed, is positioned between the inlet port 24 and the dispersing chamber 32. Valve actuator 23 can be controlled by a variety of types of electronic controllers (not shown), such as a programmable logic controller (PLC) or computer (such as an industrial grade personal computer (PC)). The dispersing chamber 32 preferably includes cascading shoulders 34, which gradually increase the width and volume of the dispersing chamber 32. Locating dowels 26 extend from the bottom of applicator body 22. Locating dowels 26 are adapted to engage with locating holes 40 (shown in FIGS. 4 and 5) in the applicator plate 28 to facilitate easy positioning of the applicator plate 28 relative to the applicator body 22. The applicator body also includes optional temperature-conditioning ports 19. Temperature-conditioning ports 19 are adapted to receive temperature-conditioned liquid—usually water—which temperature-conditions the applicator body 22, which in turn temperature-conditions the fluid material in the dispersing chamber 32. It is sometimes desirable to temperature-condition the fluid material while it is in the applicator 20 to control its viscosity.

Figure 4:
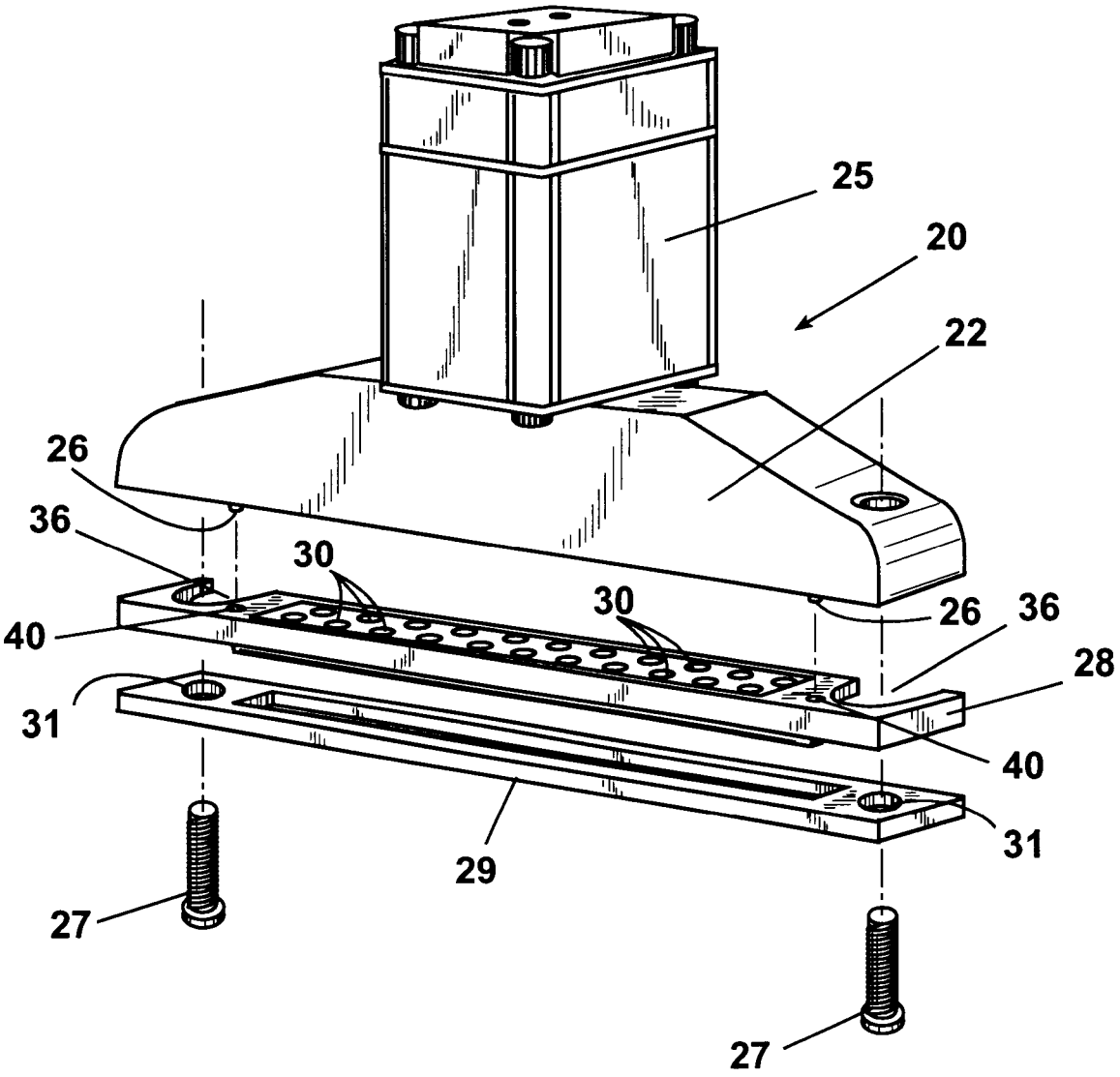
FIG. 4 is a perspective assembly view of an embodiment of a multiple orifice applicator.

FIG. 4 illustrates a perspective assembly view of the multiple orifice applicator 20. As shown in FIG. 4, applicator plate 28 includes a plurality of orifices 30, through which fluid material passing through dispersing chamber 32 is dispensed. When applicator plate 28 is installed onto applicator body 22, locating holes 40 are engaged with locating dowels 26. Then, retaining plate 29 is abutted to applicator plate 28, and bolts 27 are passed through retaining plate holes 31 and applicator plate holes 36, into applicator body 22. In this way, applicator plate 28 is secured to applicator body 22. Preferably, applicator plate holes 36 are open slots on one side. This particular configuration of elements enables the applicator plate 28 to be easily installed and uninstalled without having to stop the manufacturing process for an extended period of time and without having to install or uninstall the entire applicator 20. Changing the applicator plate 28 consists simply of loosing bolts 27 to remove applicator plate 28, installing a new applicator 28, and tightening bolts 27. It is desirable to be able to quickly change applicator plates to accommodate different patterns of outlet orifices 30 for different applications.

Figure 5:
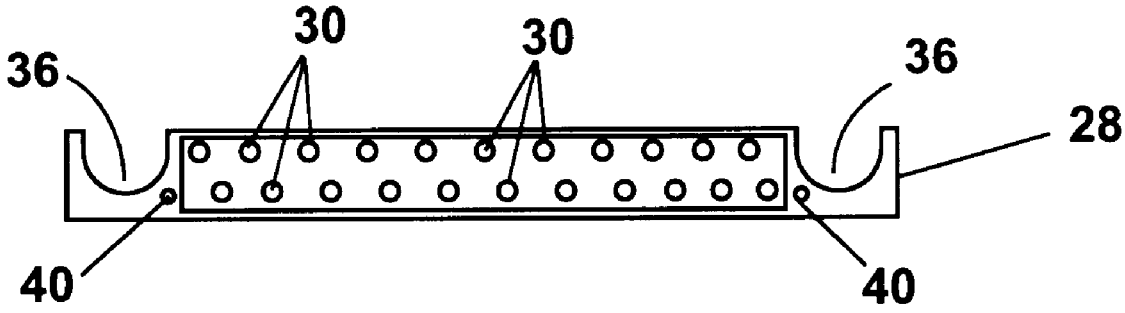
FIG. 5 is a bottom view of a first applicator plate of a multiple orifice applicator.
Figure 6:
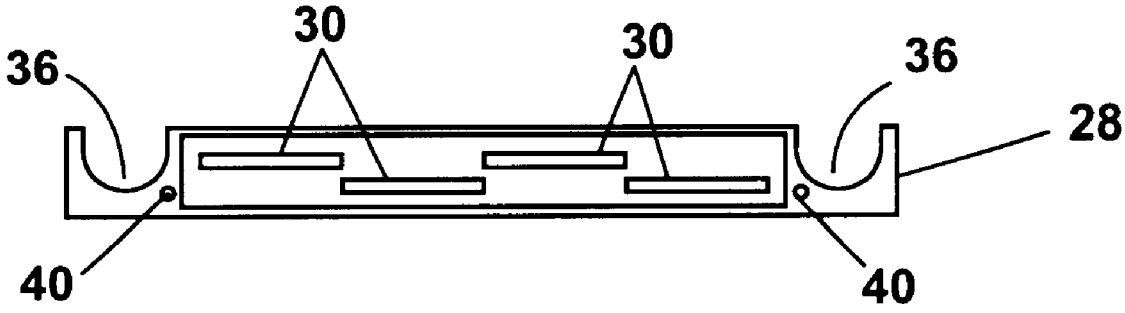
FIG. 6 is a bottom view of a second applicator plate of a multiple orifice applicator.

FIGS. 5 and 6 illustrate bottom views of alternative embodiments of the applicator plate 28. In particular, FIG. 5 illustrates an applicator plate 28 having two rows of round outlet orifices 30, whereas FIG. 6 illustrates an applicator plate 28 having two rows of elongated rectangular outlet orifices 30. Further, many other patterns and shapes of outlet orifices 30 are useful, depending on the particular application, and are within the scope of this invention. While the outlet orifices may be formed simply by machining orifices in the applicator plate 28, it may be desirable to use orifice inserts made from an abrasive-resistant material, such as carbide, depending on the abrasiveness of the fluid material being dispensed. In sum, the number, size and shape of the outlet orifices 30 are determined by the width, distance, viscosity and tool tip speed necessary to form the desired formation of the material, which may or may not include ridges.

Figure 9:
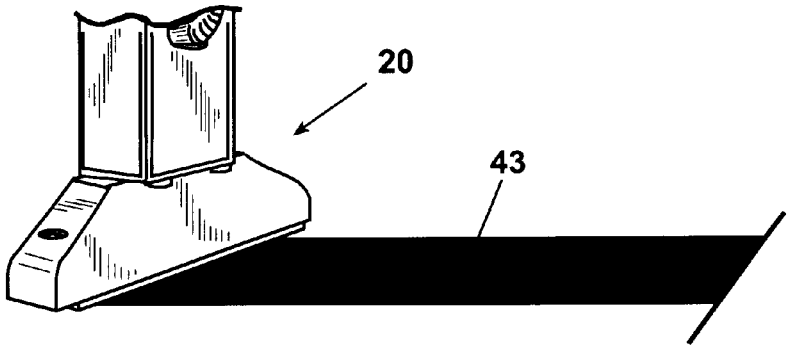
FIG. 9 is a perspective view of a multiple orifice applicator, wherein the multiple distinct rows of fluid material are blended and merged together without rotating the subject applicator.

When a dispensing system—such as those described in connection with FIGS. 1*a* and 1*b*—is used with the multiple orifice applicator 20, fluid material is caused to flow from the dispensing system into the inlet port 24 of the applicator 20. In response to a control signal, the valve actuator 23 of integrated valve 25 opens to permit fluid material to flow into the dispersing chamber 32. The integrated valve 25 is effective to stop the material from dripping from the applicator 20 when the valve is closed. The terraced shoulders 34 of the dispersing chamber 32 allow the flow of fluid material entering the inlet port 24 to disperse and spread out as the fluid material descends in the dispersing chamber 32. When the fluid reaches the bottom of the dispersing chamber 32, the fluid material is dispensed through the plurality of orifices 30 onto the work piece 106 (of FIG. 1A). The shape of positioning of the outlet orifices 30 can be implemented either so that adjacent rows of material blend together to create a continuous band of material 43, shown in FIG. 9, or maintain discrete rows, depending on the application.

Figure 7:
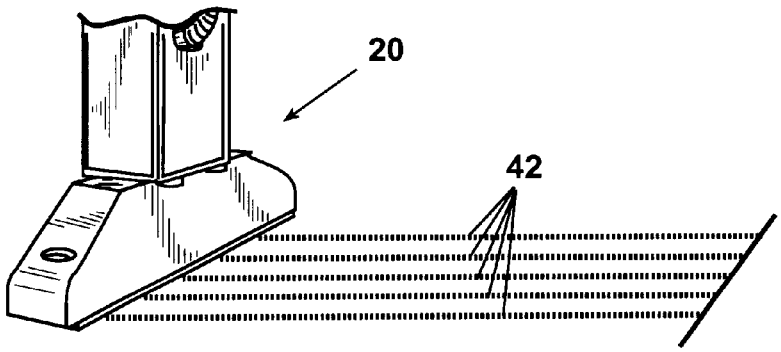
FIG. 7 is a perspective view of a multiple orifice applicator showing application of multiple distinct rows of fluid material.
Figure 8:
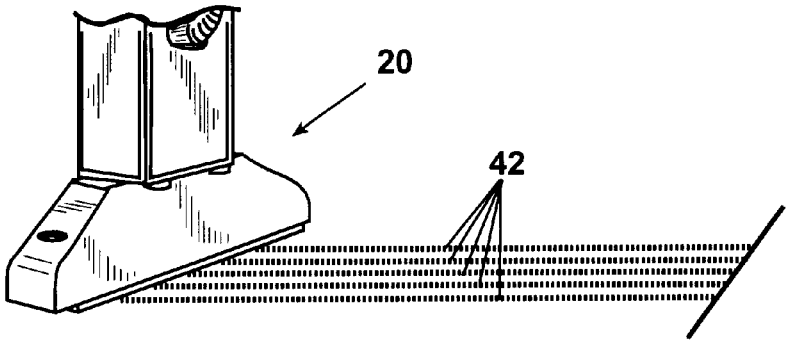
FIG. 8 is a perspective view of a multiple orifice applicator, wherein the applicator is rotated to cause the rows of fluid material to be applied closer together.

Further, as shown in FIGS. 7 and 8, the multiple orifice applicator 20, when used in connection with a robotic arm, can be used in such a manner so as to easily adjust the distance between adjacent rows of fluid material applied to the work piece. FIG. 7 illustrates rows of fluid material 42 applied to a work piece by applicator 20 wherein the work piece is moved directly perpendicular to the applicator 20. In this way, the rows of fluid material on the work piece are spaced the same distance apart as the outlet orifices 30 on the applicator plate 28. If it is desirable to reduce the distance between adjacent rows of fluid material on the work piece, one way of accomplishing this objective is to change the applicator plate 28 to one having outlet orifices 30 that are more closely spaced. Alternatively, and perhaps more efficiently, the multiple orifice applicator 20, using the same applicator plate 28, can be rotated by the robot arm relative to the work piece. Then, as the work piece is moved relative to the applicator 20, the rows of fluid material applied to the work piece are closer together. Depending on the shape and pattern of the outlet orifices 30, a greater rotation of the applicator 20 produces rows of fluid material on the work piece that are closer together.

The use of the multiple orifice applicator 20 in connection with a metering and dispensing system for dispensing fluid materials provides several advantages over known prior art methods. For example, the multiple orifice applicator 20 facilitates the creation of relatively wide bands of fluid materials in a single pass of the applicator. Further, the thickness of the applied material is more constant compared to other methods. Moreover, the multiple orifice applicator 20 does not experience the "overspray" problems associated with swirling techniques described above. Another advantage is that the use of the integrated valve 25 at a position in the fluid path relatively close to the dispersing chamber 32 increases the responsiveness of the system when beginning to dispense fluid material and when stopping the application of fluid material, thus facilitating precise starts of fluid flow and minimizing undesirable dripping of material at the end of an application cycle. Yet another advantage of the multiple orifice applicator 20 is that the connecting dowels 26 provide a convenient way to locate the applicator plate 28 relative to the applicator body 22, and retaining plate 29 provides a convenient method of installing and uninstalling different applicator plates 28. Thus, applicator plates can be easily and quickly changed, which facilitates quick and efficient changeover without significant downtime for the system. Yet another advantage of the multiple orifice applicator 20 is that it provides an effective alternative to using relatively expensive pre-die-cut melt pads. Instead of maintaining an inventory of different sized melt pads and manually applying them to various work pieces, the disclosed system (using the multiple orifice applicator) can be used to create a variety of different sizes of fluid material bands on a work piece during the manufacturing process, plus the end user can purchase the fluid material in large bulk containers to manufacture any size pattern. Thus, the need to inventory different melt pads is eliminated. Finally, the multiple orifice applicator 20 does not have any additional moving parts—like the swirling devices have—that require additional maintenance and repair.

A preferred embodiment of the present invention has been described hereinabove. However, a person skilled in the art will recognize that the present invention can be used in a variety of different forms. Therefore, the following claims should be studied to determine the true scope and content of the invention.

What is claimed is:

1. A system for applying a fluid material to a work piece, comprising:

a source of fluid material;

a multiple orifice applicator remotely located from said source of fluid material, said multiple orifice applicator having:

an inlet port;

a dispersing chamber in fluid communication with said inlet port;

a plurality of outlet orifices in fluid communication with said source of fluid material;

an integrated flow control valve positioned between said inlet port and said dispersing chamber; and wherein a fluid flow path between said valve and said dispersing chamber is substantially linear; and an electronically-controlled robotic arm having said multiple orifice applicator attached thereto, said electronically-controlled robotic arm being configured to selectively move said multiple orifice applicator relative to the work piece.

2. The system of claim 1, including a means for applying sufficient pressure to said fluid material such that said fluid materials is streamed from said multiple orifice applicator.

3. The system of claim 1, wherein said dispersing chamber of said multiple orifice applicator includes a plurality of cascading shoulders between said inlet port and said outlet orifices.

4. The system of claim 1, further comprising an electronic motion controller that provides signals to control the movement of said electronically-controlled robot.

5. The system of claim 1, further comprising a metering system in fluid communication with said fluid source and said multiple orifice applicator for metering desired volumes of the fluid material.

6. The system of claim 1, further comprising a temperature-conditioning device for temperature-conditioning the fluid material prior to the fluid material being dispensed from said multiple orifice applicator.

7. The system of claim 6, wherein said temperature-conditioning device is a temperature exchanger positioned between said source of fluid material and said multiple orifice applicator.

8. The system of claim 1, further comprising a source of air pressure to cause the fluid to flow from said source of fluid material to said multiple orifice applicator.

9. The system of claim 1, wherein said plurality of outlet orifices are positioned so as to dispense a plurality of adjacent rows of the fluid material that collectively create a continuous band of material on said work piece.

10. The system of claim 1, wherein the work piece a component of an automobile/transportation vehicle.

11. A system for applying a fluid material to a work piece, comprising:

a source of fluid material;

a multiple orifice applicator having a plurality of outlet orifices disposed in a detachable applicator plate, said outlet orifices being in fluid communication with said source of fluid material;

an electronically-controlled robotic arm having said multiple orifice applicator attached thereto, said electronically-controlled robotic arm being configured to selectively move said multiple orifice applicator relative to the work piece; and wherein said source of fluid material is remote from said multiple orifice applicator.

12. The system of claim 11, wherein said applicator plate includes at least one locating hole for engaging with a dowel to position said applicator plate relative to said multiple orifice applicator.

13. A system for applying fluid material to a work piece, comprising:

a source of fluid material;

a multiple orifice applicator in fluid communication with said source of fluid material, wherein said multiple orifice applicator has:

an inlet port;

at least two rows of outlet orifices for dispensing the fluid material onto the work piece, wherein said orifices that comprise adjacent ones of said rows are laterally offset from each other; and a dispersing chamber in fluid communication with said inlet port and said plurality of outlet orifices, said dispersing chamber having a plurality of cascading shoulders between said inlet port and said outlet orifices; and a mechanism for controlling relative positioning of said multiple orifice applicator and the work piece.

14. The system of claim 13, further comprising a temperature-conditioning device for temperature-conditioning the fluid material prior to the fluid material being dispensed from said multiple orifice applicator.

15. The system of claim 13, wherein said multiple orifice applicator further comprises a valve that selectively allows the fluid material to flow into said dispersing chamber.

16. A system for applying fluid material to a work piece, comprising:

a source of fluid material;

a multiple orifice applicator in fluid communication with said source of fluid material;

a mechanism for controlling relative positioning of said multiple orifice applicator and the work piece; and wherein said multiple orifice applicator includes:

an inlet port;

a plurality of outlet orifices having inlet ends, said inlet ends being tapered; and a dispersing chamber positioned in a flow path between said inlet port and said outlet orifices, said dispersing chamber having a plurality of cascading shoulders between said inlet port and said outlet orifices.

17. The system of claim 16, wherein said multiple orifice applicator further includes a valve that selectively allows the fluid material to flow into said dispersing chamber.

18. The system of claim 16, further comprising a temperature-conditioning device for temperature-conditioning the fluid material prior to the fluid material being dispensed from said multiple orifice applicator.

* * * * *

UNITED STATES PATENT AND TRADEMARK OFFICE

CERTIFICATE OF CORRECTION

PATENT NO. : 6,695,923 B1
DATED : February 24, 2004
INVENTOR(S) : Carl L. Schultz It is certified that error appears in the above-identified patent and that said Letters Patent is hereby corrected as shown below:

Column 7,
Line 51, please add -- is -- between “piece” and “a”

Signed and Sealed this

Twenty-ninth Day of June, 2004

JON W. DUDAS
*Acting Director of the United States Patent and Trademark Office*